US010618701B2

(12) United States Patent
Lam

(10) Patent No.: US 10,618,701 B2
(45) Date of Patent: Apr. 14, 2020

(54) ENHANCED PRODUCE CONTAINER

(71) Applicant: Multisteps Pty Ltd, Silverwater NSW (AU)

(72) Inventor: John Lam, Silverwater (AU)

(73) Assignee: Multisteps Pty Ltd, Silverwater, NSW (AU)

( * ) Notice: Subject to any disclaimer, the term of this patent is extended or adjusted under 35 U.S.C. 154(b) by 27 days.

(21) Appl. No.: 15/649,886

(22) Filed: Jul. 14, 2017

(65) Prior Publication Data

US 2018/0016064 A1 Jan. 18, 2018

(30) Foreign Application Priority Data

Jul. 15, 2016 (AU) ..... 2016902796

(51) Int. Cl.

| | |
|---|---|
| ***B65D 43/08*** | (2006.01) |
| ***B65D 85/34*** | (2006.01) |
| ***B65D 5/66*** | (2006.01) |
| ***B65D 43/16*** | (2006.01) |

(52) U.S. Cl.

CPC ..... *B65D 43/08* (2013.01); *B65D 5/66* (2013.01); *B65D 43/16* (2013.01); *B65D 85/34* (2013.01)

(58) Field of Classification Search

CPC ..... B65D 43/08; B65D 85/34; B65D 43/162
USPC ..... 220/839, 4.23
See application file for complete search history.

(56) References Cited

U.S. PATENT DOCUMENTS 6,609,623 B2 * 8/2003 Chou ..... B65D 43/162 220/4.23
D625,180 S * 10/2010 Enriquez ..... D9/425
2015/0321799 A1 11/2015 Lam

FOREIGN PATENT DOCUMENTS

CN 204606420 9/2015

* cited by examiner

*Primary Examiner* — Jeffrey R Allen
(74) *Attorney, Agent, or Firm* — Alston & Bird LLP

(57) ABSTRACT

The present invention relates to a produce container which includes a receptacle and a lid. The receptacle has a mouth circumscribed by a rim which has a first flange. The lid is releasably attachable to the receptacle to close off the mouth. The lid has a skirt portion adapted to interact with the rim of the receptacle to retain the lid on the receptacle and a second flange projecting from the skirt portion of the lid. One or more selected members of the produce container include reinforcing means.

22 Claims, 6 Drawing Sheets

ENHANCED PRODUCE CONTAINER

CROSS-REFERENCE TO RELATED APPLICATION

This application claims priority to and the benefit of Australian Provisional Patent Application No 2016902796 filed on Jul. 15, 2016, the entire disclosure of which as is hereby incorporated by reference herein.

BACKGROUND

Technical Field

The present invention broadly relates to a produce container. In particular, the present invention relates to a produce container which is reinforced at selected locations.

Produce containers for carrying fresh produce often have one or more flanges or tabs onto which a user can grip for the purpose of separating the lid from the receptacle. The flanges or tabs of produce containers currently available in the marketplace however have a shortcoming that they are quite flimsy. As such, the flanges or tabs are quite susceptible to deformation when gripped by the user. This often leads to the user having difficulty in opening the lid of a container in an efficient manner. Also, substantially deformed flanges or tabs are likely to disturb or even harm the produce carried within the container.

Also, a raised platform is commonly provided in the lid of produce containers. The raised platform serves the purpose of providing a bit of extra headroom beyond the top of the receptacle. The raised platform however has a shortcoming that its surface is quite prone to bending downwardly or caving in, particularly when the containers are stacked on top of one another during transportation or being manipulated for retail display.

It is an object of the present invention to provide a produce container with reinforcement which may overcome or at least ameliorate the above shortcomings or which will at least provide a useful alternative.

BRIEF SUMMARY

According to a first aspect of the present invention, there is provided a produce container including: a receptacle with a mouth circumscribed by a rim which has a first flange; a lid releasably attachable to the receptacle to close off the mouth, the lid having a skirt portion adapted to interact with the rim of the receptacle to retain the lid on the receptacle and a second flange projecting from the skirt portion of the lid; wherein one or more selected members of the produce container include reinforcing means.

In certain embodiments, the reinforcing means are integral to the one or more selected members. In additional embodiments, the reinforcing means include a plurality of embossments or debossments.

According to second aspect of the present invention, there is provided a produce container including: a receptacle with a mouth circumscribed by a rim which has a first flange; a lid releasably attachable to the receptacle to close off the mouth, the lid having a skirt portion adapted to interact with the rim of the receptacle to retain the lid on the receptacle and a second flange projecting from the skirt portion of the lid; wherein at least one of the first and second flanges has reinforcing means.

In at least one exemplary and advantageous embodiment, each of the first and second flanges has reinforcing means.

In certain embodiments, the reinforcing means includes an embossed or debossed surface. In other embodiments, the embossed or debossed surface includes an array of formations. In still other embodiments, the formations are in the form of dimples or protuberances. The dimples or protuberances may form a selected pattern.

In certain embodiments, the first flange extends outwardly from the front and sides of the rim of the receptacle. In still other embodiments, the second flange extends outwardly from the front and sides of the skirt portion of the lid thereby corresponding with the first flange.

In at least one exemplary and advantageous embodiment, the first and second flanges are spaced apart when the lid is closed. In certain embodiments, the first and second flanges are spaced apart by the skirt portion which overlies and interacts with the rim. In other embodiments, the skirt portion has a first engaging means which is adapted in use to engage a second engaging means of the rim thereby securing the lid to the receptacle.

In certain embodiments, at least the first or second flange is gripped in use to facilitate opening or removal of the lid from the receptacle. The reinforcing means are adapted to increase the sturdiness of the first and second flanges so as to reduce the likelihood of deformation when the first and/or second flanges are being gripped.

According to a third aspect of the present invention, there is provided a produce container including: a receptacle with a mouth circumscribed by a rim; a lid releasably attachable to the receptacle to close off the mouth, the lid having a raised platform with a periphery; wherein the platform includes reinforcing means which extends along the periphery.

In certain embodiments, the reinforcing means includes an embossed or debossed band. In other embodiments, the band forms a continuous loop. In still other embodiments, the band is elevated. In at least one embodiment, the embossed or debossed band includes an array of formations. The formations may be in the form of dimples or protuberances. The dimples or protuberances may form a selected pattern.

BRIEF DESCRIPTION OF THE FIGURES

The invention may be better understood from the following non-limiting description of the primary exemplary embodiment, in which.

DETAILED DESCRIPTION OF VARIOUS EMBODIMENTS

Figure 1:
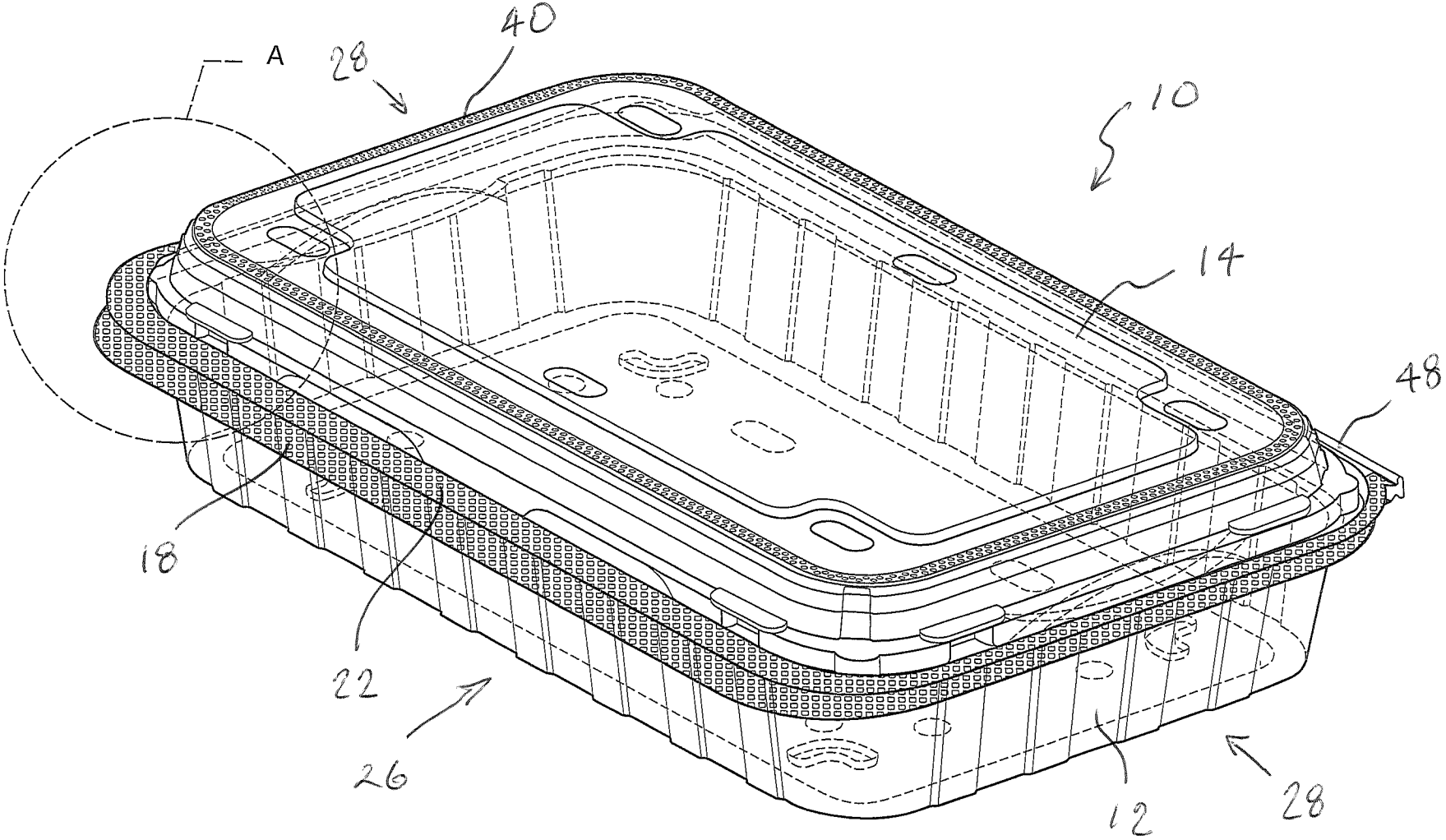
FIG. 1 is a perspective view from top of a produce container in accordance with the exemplary embodiment of the present invention.
Figure 2:
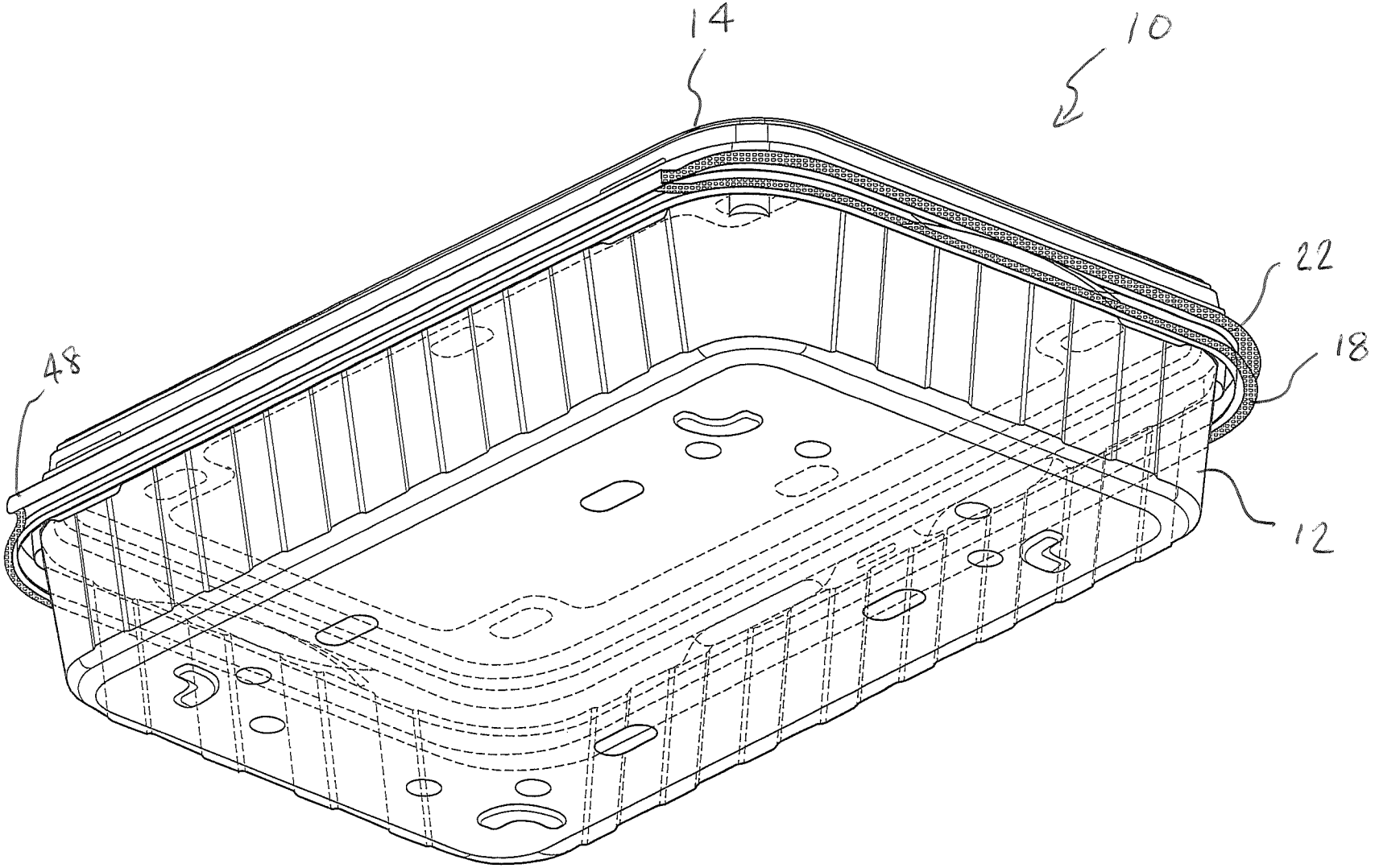
FIG. 2 is a perspective view from bottom of the produce container of FIG. 1.

Referring to FIGS. 1 and 2, a produce container 10 having a receptacle 12 and lid 14 is shown. The receptacle 12 has a mouth (not visible when the lid 14 is closed) circumscribed by a rim 16 (see FIG. 5) which has a first flange 18. The lid 14 is releasably attachable to the receptacle 12 to close off the mouth. The lid 14 has a skirt portion 20 adapted to interact with the rim 16 of the receptacle 12 to retain the lid 14 on the receptacle 12. The lid 14 also has a second flange 22 projecting from the skirt portion 20 of the lid 14. As shown FIG. 1, both of the first and second flanges 18 & 22, being members of the produce container 10, include reinforcing means.

As shown in FIGS. 1 and 2, the first flange 18 extends outwardly from the front 26 and sides 28 of the rim 16 of the receptacle 12. The second flange 22 also extends outwardly from the front 26 and sides 28 of the skirt portion 20 of the lid 14 thereby corresponding with the first flange 18.

In an exemplary advantageous embodiment, the first and second flanges 18 & 22 are spaced apart when the lid 14 is closed. The first and second flanges 18 & 22 are spaced apart by the skirt portion 20 which overlies and interacts with the rim 16. The skirt portion 20 has three engaging means in the form of protrusions 30 which are adapted in use to engage three corresponding engaging means in the form of recesses 32 of the rim 16 thereby securing the lid 14 to the receptacle 12.

Figure 3:
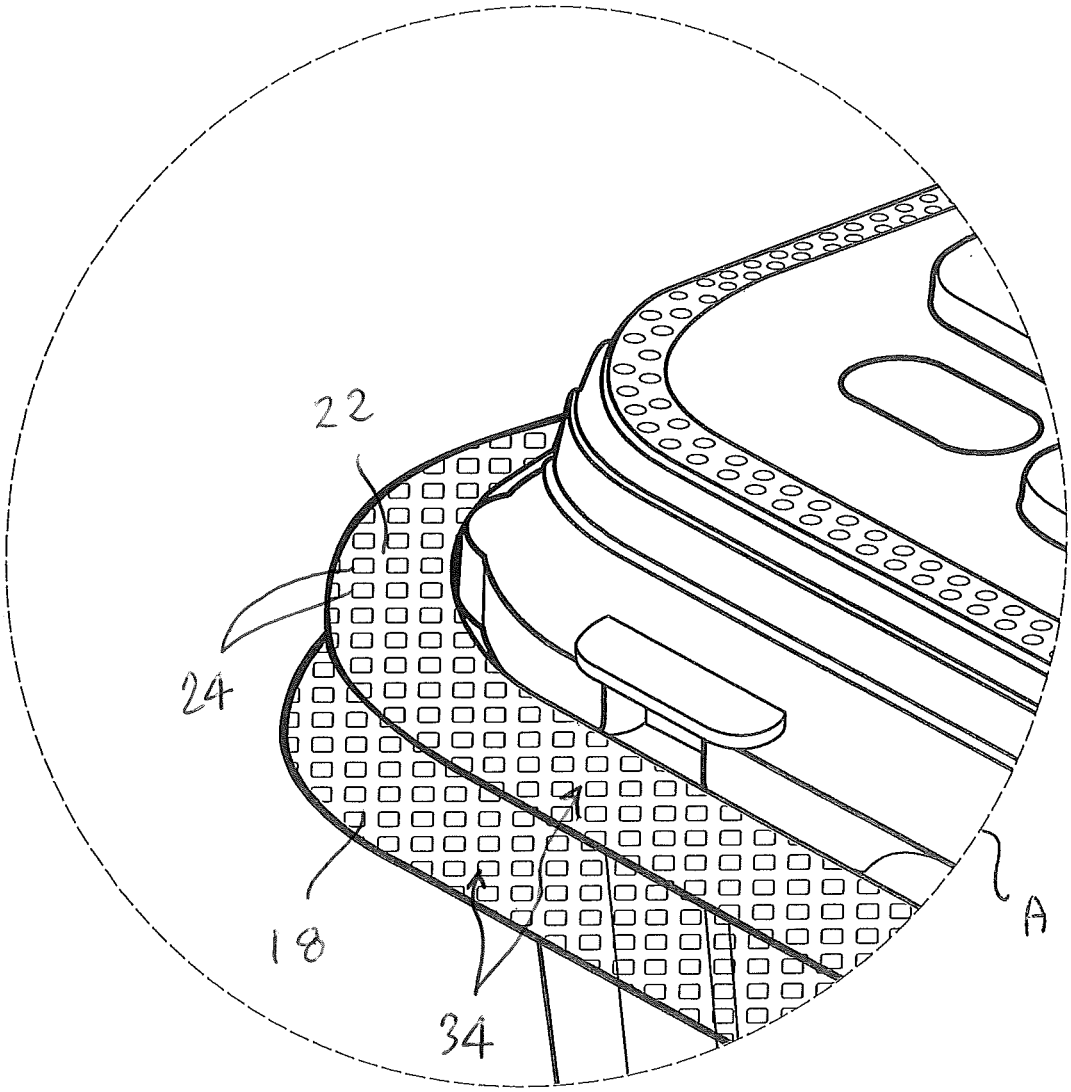
FIG. 3 is a magnified view of a corner of the produce container of FIG. 1 illustrating the reinforcing means.

The reinforcing means are integral to the first and second flanges 18 & 22. As shown in FIG. 3, the reinforcing means includes an embossed or debossed surface 18, 22. Whether the surfaces 18 & 22 are embossed or debossed depends on one's viewpoint. Each of the debossed (or embossed) surface 18, 22 includes an array of formations 24 which are in the form of dimples (or protuberances in the case of embossment). In this embodiment, the dimples (or protuberances) form a regular pattern 34.

Figure 6:
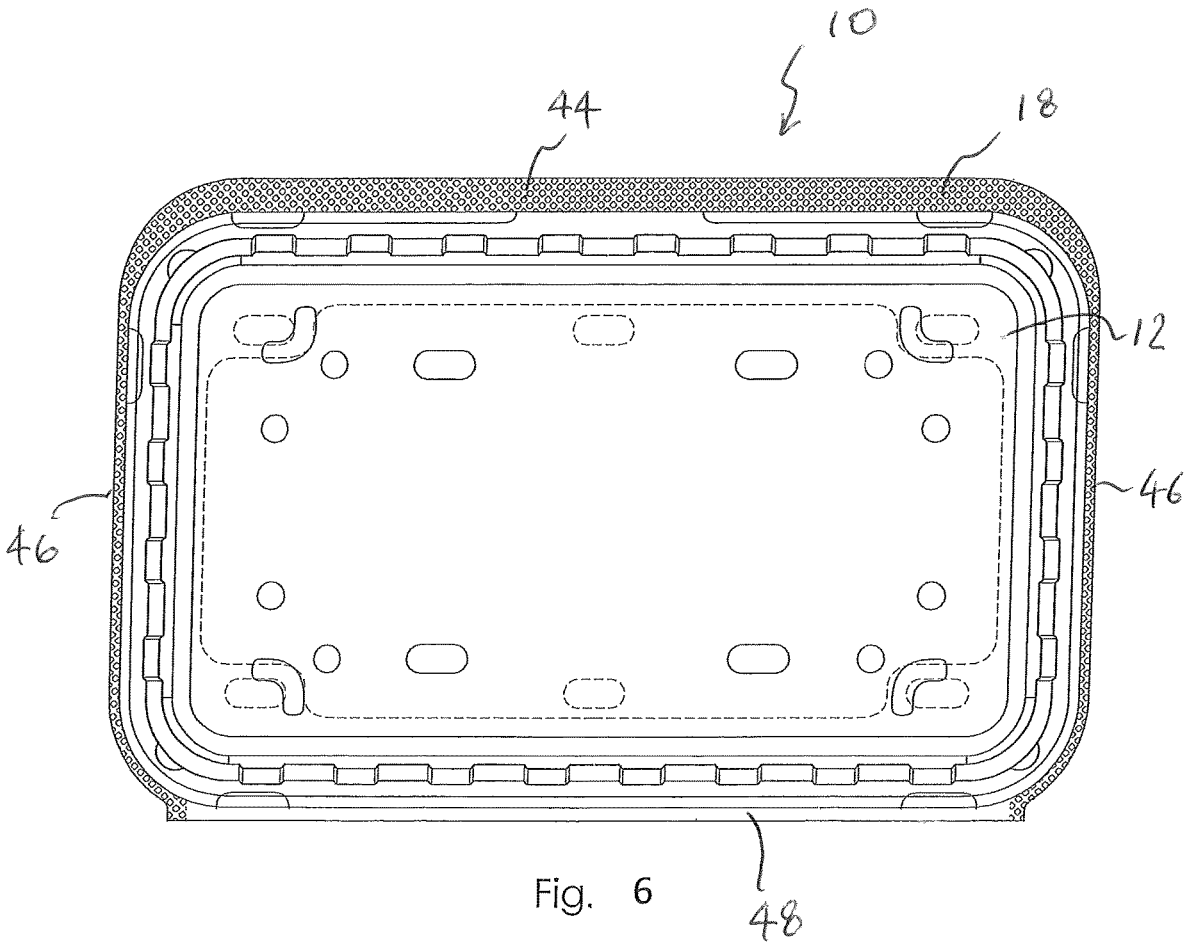
FIG. 6 is a bottom plan view of the produce container of FIG. 1.
Figure 7:
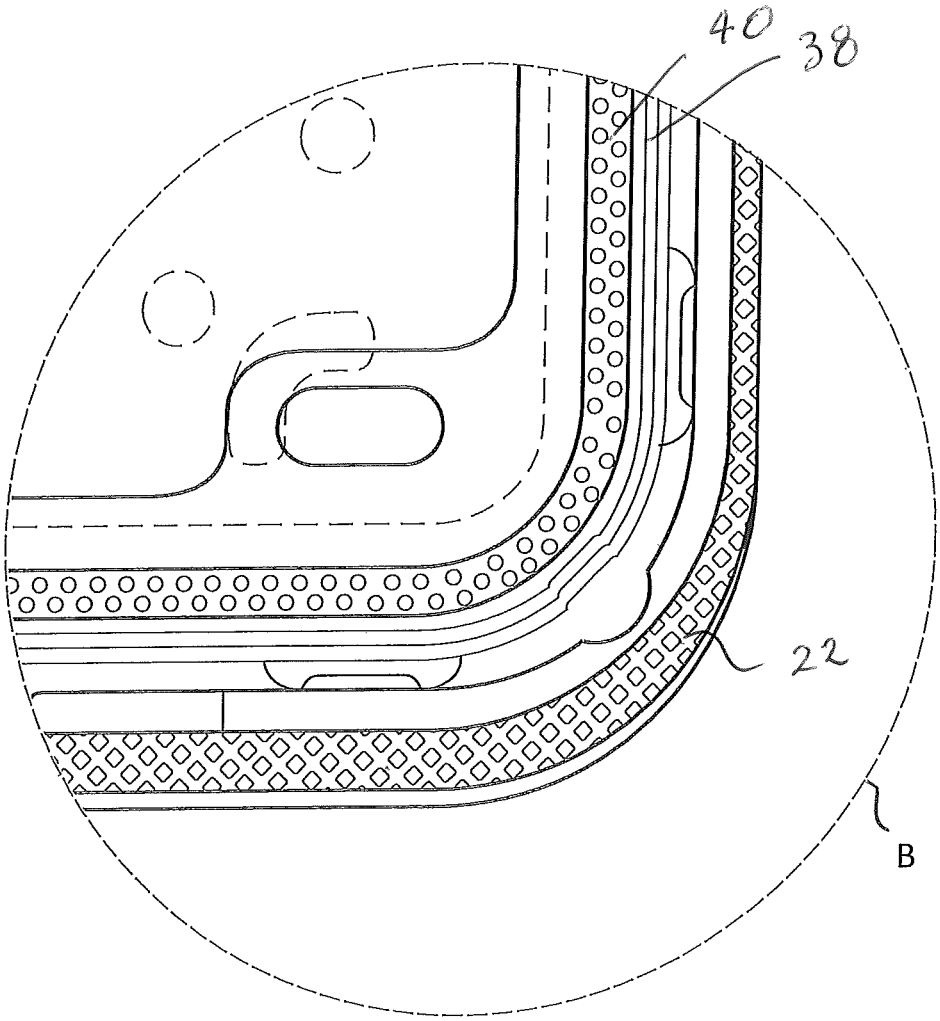
FIG. 7 is a magnified view of a corner of the produce container of FIG. 1.

Referring to FIGS. 6 and 7, the portion 44 of the flange 18 extending from the front of the container 10 is wider than that 46 extending from the lateral sides of the container 10. One end of each of the side portions 46 is joined to the hinge 48 located in the rear of the container 10.

In use, either or both of the first or second flanges is/are gripped to facilitate opening or removal of the lid 14 from the receptacle 12. The reinforcing means are designed and configured to increase the sturdiness of the first and second flanges 18 & 22 so as to reduce the likelihood of deformation when the first and/or second flanges 18 &22 are being gripped for the purpose of disengaging the protrusions 30 from the recesses 32.

Figure 4:
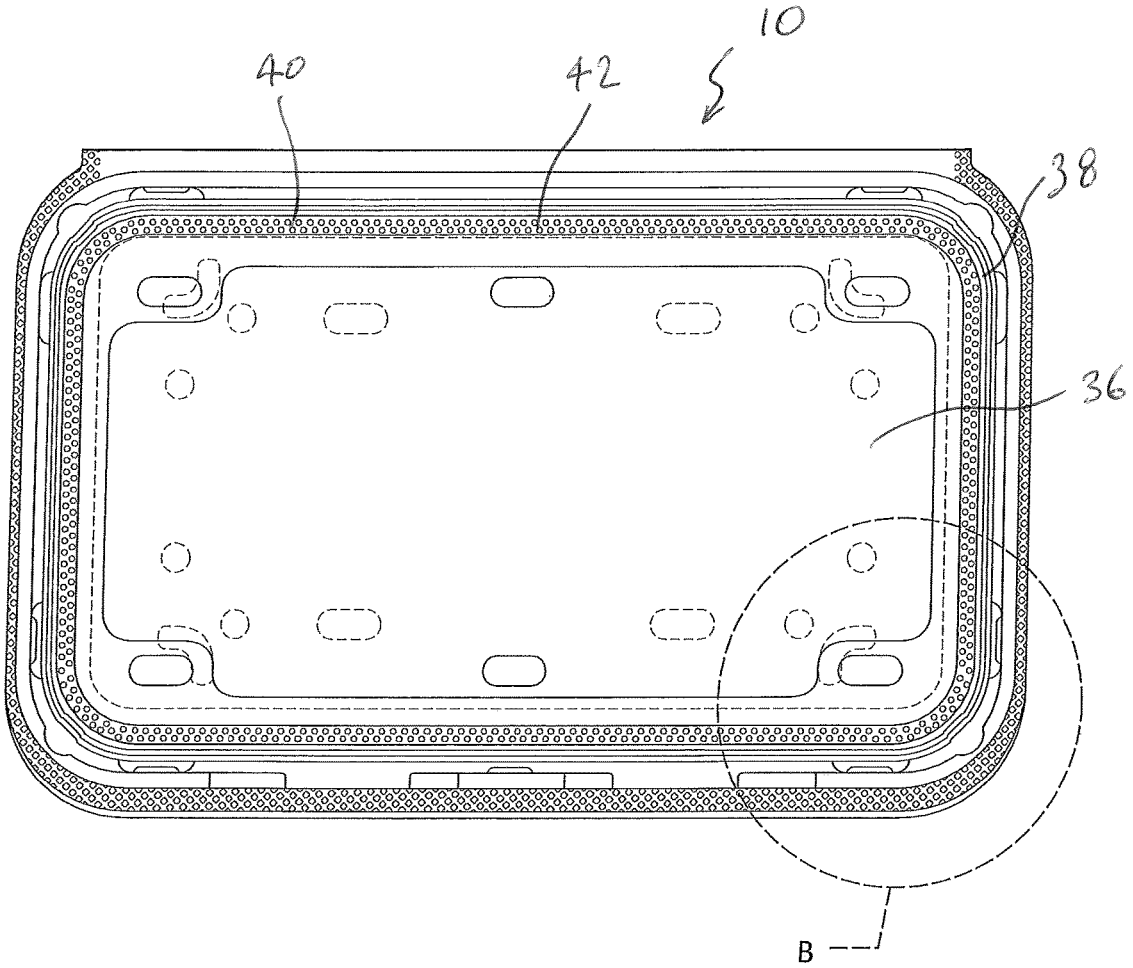
FIG. 4 is top plan view of the produce container of FIG. 1.
Figure 5:
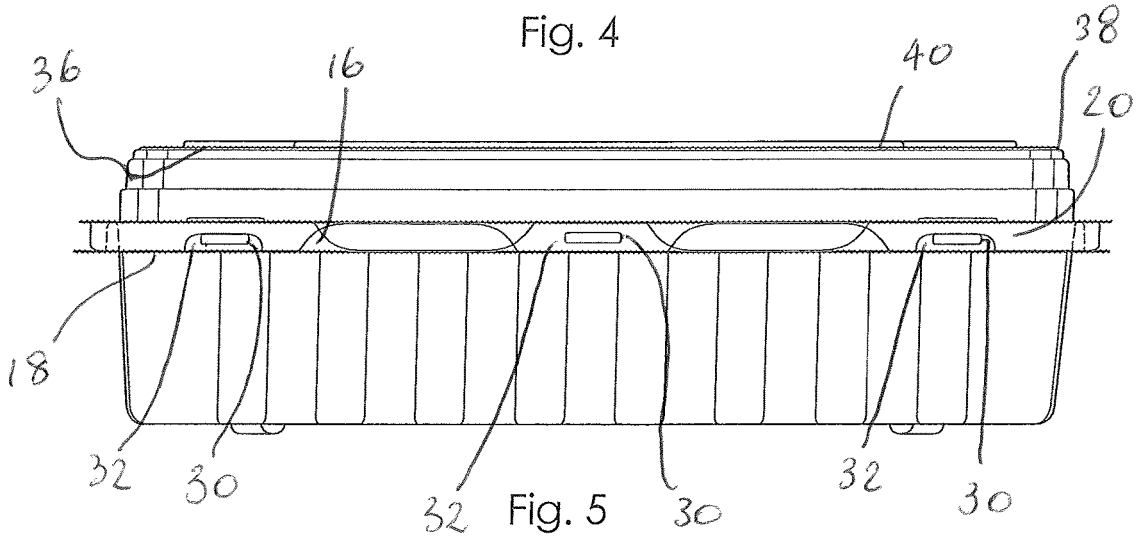
FIG. 5 is a front elevation of the produce container of FIG. 1.

Turning to FIGS. 4 and 5, the lid 14 has a raised platform 36 with a periphery 38. The platform 36 also includes reinforcing means which extends along the periphery 38. The reinforcing means includes and debossed (or embossed) band 40 which is elevated. The band 40 forms a continuous loop 42. The debossed (or embossed) band 40 includes an array of formations in the form of dimples (or protuberances). In the present embodiment, the dimples (or protuberances) form a selected pattern.

In use, when the container 10 is placed underneath another container during transportation or being manipulated for retail display, the periphery 38 serves the function of enhancing the overall integrity of the entire platform 36. As such, the platform 36 is more capable of sustaining a higher load if necessary and having a higher degree of resiliency to return to its original shape after being pressed or subjected to an external force.

Now that an exemplary advantageous embodiment of the present invention has been described in some detail, it will be apparent to a skilled person in the art that the produce container of the present invention may offer at least the following advantages: it strengthens the raised platform of the lid and enhances its resiliency; it increases the sturdiness of the flanges of the lid and receptacle thereby enhancing the efficacy of the locking and unlocking mechanism between the lid and the receptacle; and it is economical to manufacture.

Those skilled in the art will appreciate that the invention described herein is susceptible to variations and modifications other than those specifically described. For instance, the reinforcing means may take other forms or shapes. The pattern formed by the reinforcing means may also differ. Furthermore, the lid of the container may be hinged to the receptacle as illustrated in the embodiment described above or be totally detachable from the receptacle. In the latter case, the reinforced flanges may extend from the rear of the container as well forming a continuous loop around the perimeter of the container. All such variations and modifications are to be considered within the scope and spirit of the present invention the nature of which is to be determined from the foregoing description.

The invention claimed is:

1. A produce container comprising:

a receptacle with a mouth circumscribed by a rim having a front, two opposing sides, a hinge, and a first flange, one end of each of the two opposing sides being joined to opposing ends of the hinge, an opposing end of each of the two opposing sides being joined to opposing ends of the front; and a lid releasably attachable to the receptacle to close off the mouth, the lid having: (1) a skirt portion adapted to interact with the rim of the receptacle to retain the lid on the receptacle; and (2) a second flange projecting from the skirt portion of the lid, wherein one or more selected members of the produce container include reinforcing means extending continuously along an entire length of at least one of: the front or at least one of the opposing sides of the rim of the produce container.

2. The produce container of claim 1, wherein the reinforcing means are integral to the one or more selected members.

3. The produce container of claim 1, wherein the reinforcing means include a plurality of embossments or debossments.

4. A produce container comprising:

a receptacle with a mouth circumscribed by a rim having a front, two opposing sides, a hinge, and a first flange, one end of each of the two opposing sides being joined to opposing ends of the hinge, an opposing end of each of the two opposing sides being joined to opposing ends of the front; and a lid releasably attachable to the receptacle to close off the mouth, the lid having a skirt portion adapted to interact with the rim of the receptacle to retain the lid on the receptacle and a second flange projecting from the skirt portion of the lid, wherein:

the first flange extends continuously along an entire length of the rim; and at least the first flange has reinforcing means extending continuously along an entire length of at least one of: the front or at least one of the opposing sides of at least the first flange of the rim.

5. A produce container of claim 4, wherein each of the first and second flanges has reinforcing means.

6. The produce container of claim 4, wherein the reinforcing means includes an embossed or debossed surface.

7. The produce container of claim 6, wherein the embossed or debossed surface includes an array of formations.

8. The produce container of claim 7, wherein the formations are in the form of dimples or protuberances.

9. The produce container of claim 8, wherein the dimples or protuberances form a selected pattern.

10. The produce container of claim 4, wherein the first flange extends outwardly from the front and sides of the rim of the receptacle.

11. The produce container of claim 4, wherein the second flange extends outwardly from the front and sides of the skirt portion of the lid thereby corresponding with the first flange.

12. The produce container of claim 4, wherein the first and second flanges are spaced apart when the lid is closed.

13. The produce container of claim 11, wherein the first and second flanges are spaced apart by the skirt portion which overlies and interacts with the rim.

14. The produce container of claim 4, wherein the skirt portion has a first engaging means which is adapted in use to engage a second engaging means of the rim thereby securing the lid to the receptacle.

15. The produce container of claim 4, wherein at least the first or second flange is gripped in use to facilitate opening or removal of the lid from the receptacle.

16. The produce container of claim 1, wherein:

the second flange projecting from the skirt portion of the lid lies in a first plane;

the lid further comprises (1) a raised platform having a periphery and lying in a second plane parallel to the first plane; and (3) at least one side portion having a height and being positioned intermediate the raised platform and the skirt portion, the raised platform being spaced apart from the second flange by a distance corresponding to the height of the at least one side portion; and the raised platform includes reinforcing means extending along the periphery.

17. The produce container of claim 16, wherein the reinforcing means includes an embossed or debossed band.

18. The produce container of claim 17, wherein the band forms a continuous loop.

19. The produce container of claim 17, wherein the embossed or debossed band includes an array of formations that are dimples or protuberances.

20. The produce container of claim 4, wherein:

the second flange projecting from the skirt portion of the lid lies in a first plane;

the lid further comprises (1) a raised platform having a periphery and lying in a second plane parallel to the first plane; and (3) at least one side portion having a height and being positioned intermediate the raised platform and the skirt portion, the raised platform being spaced apart from the second flange by a distance corresponding to the height of the at least one side portion; and the raised platform includes reinforcing means extending along the periphery.

21. The produce container of claim 20, wherein the reinforcing means form a continuous loop along the periphery.

22. The produce container of claim 20, wherein:

the reinforcing means includes an embossed or debossed band that includes an array of formations in the form of dimples or protuberances, and the dimples or protuberances form a selected pattern.

* * * * *